US005840084A

United States Patent [19]

Bella et al.

[11] Patent Number: 5,840,084

[45] Date of Patent: Nov. 24, 1998

[54] DYE BATH AND METHOD FOR REACTIVE DYEING

[75] Inventors: Otto Bella, Tryon, N.C.; Calvin M. Wicker, Jr., Spartanburg; Robert B. Login, Simpsonville, both of S.C.

[73] Assignee: Sybron Chemicals, Inc., Birmingham, N.J.

[21] Appl. No.: 755,055

[22] Filed: Nov. 22, 1996

[51] Int. Cl.[6] ..... D06P 1/382; D06P 1/384

[52] U.S. Cl. ..... 8/549; 8/584; 8/597; 8/600; 8/685

[58] Field of Search ..... 8/543–549, 584, 8/597, 685, 600, 918, 924

[56] References Cited

U.S. PATENT DOCUMENTS

| | | | |
|---|---|---|---|
| 4,201,668 | 5/1980 | May . | |
| 4,231,749 | 11/1980 | Balland . | |
| 4,242,090 | 12/1980 | von der Eltz . | |
| 4,314,819 | 2/1982 | Oschatz . | |
| 4,348,292 | 9/1982 | Ginn . | |
| 4,359,322 | 11/1982 | Neal et al. . | |
| 4,555,348 | 11/1985 | Moran . | |
| 5,047,064 | 9/1991 | Rizzardi . | |
| 5,114,427 | 5/1992 | Damm . | |
| 5,136,028 | 8/1992 | Seiler | 534/632 |
| 5,167,668 | 12/1992 | Hahnke et al. . | |
| 5,242,466 | 9/1993 | Aseervatham et al. . | |
| 5,372,611 | 12/1994 | Christie et al. . | |
| 5,382,262 | 1/1995 | Moore . | |

FOREIGN PATENT DOCUMENTS

| | | |
|---|---|---|
| 0 283 114-A2 | 9/1988 | European Pat. Off. . |
| 0 503 889-A1 | 9/1992 | European Pat. Off. . |

OTHER PUBLICATIONS

Scholtz, "Influence of Metal Traces on Dyeing With Reactive Dyestuffs, " *Text. Prax. Int.*, 47(9):826, 828, 833 (1992)—(2–page printed English Translation).

Scholtz, "Influence of Metal Traces on Dyeing With Reactive Dyestuffs," *Text. Prax. Int.*, 47(9):826, 828, 833 (1992)—(12–page typed English Translation from the USPTO).

Scholz, Carmen et al. "Influence of Metal Traces on Dyeing with Reactive Dyes", *Text. Prax Int* (1992) vol. 47 (9) pp. 826, 828, 833, In German with English abstract included.

*Kirk–Othmer Chemical Encyclopedia*, Third Edition, 8:689–697 and 809–838 (1989).

A.M. Dabdoub, Ph.D., May Chemical Co., Inc., "Industrial Chelates: Chemistry and Applications," pp. 2–27 (Feb. 15, 1995), Winter Committee Meetings, AATCC Research Committee RA 90, Charlotte, NC.

Monsanto Company Chelatron—A Technical Update, pp. 1–23 (Aug. 1995).

*Primary Examiner*—Margaret Einsmann
*Attorney, Agent, or Firm*—Panitch Schwarze Jacobs & Nadel, P.C.

[57] ABSTRACT

A phosphate-free and silicate-free aqueous alkali composition consisting essentially of water, a water soluble base selected from the group consisting essentially of alkali metal hydroxide, alkali metal carbonate and mixtures thereof, wherein the base is present in an amount sufficient to yield a composition pH of about 11 to about 12 at a composition concentration of about 0.1 wt % to about 1 wt % in a dye bath, and an aminopolycarboxylate sequestrant in an amount sufficient to sequester metal ion impurities and prevent destructive reactive dye hydrolysis when the composition is used to dye fabric in the presence of reactive dye and metal ion impurities. Also disclosed is a dye bath containing the composition and a method of using the composition in reactive dyeing.

65 Claims, No Drawings

DYE BATH AND METHOD FOR REACTIVE DYEING

BACKGROUND OF THE INVENTION

The present invention relates to the reactive dyeing of fabrics. More particularly, the present invention relates to a novel aqueous alkaline composition used in the reactive dyeing of fabrics that both sequesters metal ion impurities and retards destructive reactive dye hydrolysis.

Fiber reactive dyes, now typically called "reactive dyes," were originally introduced during the 1950s and quickly became the dominant class of cotton dye. Cotton and other cellulose-based fibers are the major fibers dyed with reactive dyes. Since reactive dyes are used perhaps most extensively with cotton fibers, the description herein will focus on the use of reactive dyes with cotton, although those skilled in the art would understand that the present invention relates to the use of the alkali composition on other types of fibers where reactive dyeing might be considered.

Conventionally, reactive dyes are used in the presence of a neutral salt, for example sodium sulfate (Glauber's salt) or sodium chloride, and the aqueous bath is stirred and heated to the temperature appropriate for the particular reactive dye for the appropriate time. During this stage, the dye is absorbed by the fabric as the result of the "salting out" effect of the salt which had been added. The salting out step places the dye molecules in very close proximity to the molecules of the fabric, but the dye is not yet held fast to the fibers of the fabric.

After the salting out step occurs, there is a reaction step, during which an alkaline material is added to promote a chemical reaction between the dye and the fabric. As a result of the reaction, the dye becomes chemically bound to the fabric As used herein, the term "fabric" includes not only the planar textile structure produced by interlacing yarns, fibers or filaments, including woven, non-woven and knitted fabrics, but also the yarns, fibers or filaments themselves.

A reactive dye molecule comprises a chromophore and a chemically reactive function. The chemically reactive function reacts with hydroxyl groups found on the cellulose molecules of cotton, under alkaline conditions, to form a covalent bond between the chromophore, of the dye molecule and the reactive group of the fiber molecules, through bridging groups linking the chromophore and dye reactive function. Such covalent bonds hold the dye on the substrate even under extreme conditions that would easily remove other classes of dye. With reference to cotton, for example, in order to achieve this reaction of the dye with the cellulose substrate, it is required to generate an alkoxide group on the substrate to react with a functionalized carbon on the dye molecule. This nucleophilic reaction can be classed as a type of Williamson ether synthesis or a Michael addition to a double bond, depending on the type of reactive dye. A key to either type of reaction is the efficient formation of sufficient alkoxide groups on the cotton.

There is also a tendency for the dye molecule to hydrolyze. When this irreversible reaction occurs, the dye molecule is not available for reaction with the hydroxyl groups of cellulosics. The color then washes out of the fabric. Thus, hydrolysis results in a lower color yield on the fabric.

A high pH is necessary to cause the dye to bond to the fabric, but such alkalinity will also cause hydrolysis of the dye and loss of dye yield. Some dyes are more or less reactive towards both cotton alkoxide and free alkali and hence there is a competition with reactive dyes between dyeing and hydrolysis.

The pioneers in reactive dye technology quickly realized that of all of the alkalis available, soda ash (sodium carbonate) worked the best as a reaction promoter, affording high dye yields with minimal hydrolysis. Soda ash is inexpensive and readily available. It also works across the entire range of reactive dyes and is therefore the most general answer to pH adjustment. Soda ash is sold in powdered form in bags, totes, truckloads, etc., and has handling problems associated with its addition to the dye bath. In many mills, numerous bags of soda ash are moved around daily and poured into dyeing apparatus with no guarantee of uniform dissolution and therefore, there arose a need for more convenient and reliable handling and assuring uniform dissolution of alkali. Addition of soda ash to water to generate easily pumped concentrates is not possible because of the very limited solubility of soda ash. This led to the search for other liquid alkalis. Many examples exist of liquid formulations of alkali that are designed to circumvent soda ash's solubility limitations.

Another problem associated with reactive dyeing of fabrics is the typically fortuitous presence of metal ions, such as those of alkaline earth metals and heavy metals, which may be present in the dye bath, either from the water used or the other chemicals present in the dye bath or the fabric itself These metal ions are referred to herein as "tramp ions" or "tramp metal ions," because it is known that such tramp metal ions complex with dyes, reducing solubility and thereby cause variability in dyeing. Sequestrants have been recommended for overcoming this solubility problem by tying up these tramp ions before they can form insoluble complexes.

The present inventors discovered that tramp metal ions can also interfere with reactive dyes by catalyzing or otherwise causing hydrolysis of the reactive dyes. Such interference resulting in lower dye yield on the fabric is referred to herein as "destructive reactive dye hydrolysis." Until this discovery, this problem was not understood and therefore, no one even addressed a solution to the hydrolysis in reactive dyeing of fabrics in the presence of tramp metal ions.

Exemplary of prior art alkali reaction promoters or auxiliaries and their use are the following.

One important type of alkali formulation based on a premixed soluble alkali comprises an aqueous solution containing tri-potassium phosphate, potassium hydroxide and/or sodium hydroxide, and potassium carbonate and/or sodium carbonate, developed by Sybron Chemicals Inc. of Birmingham, N.J., the assignee of the present invention. This type of alkali auxiliary is described in U.S. Pat. No. 4,555,348 (Moran) and in European Patent 0 283 114 (DeGuzman et al.), and is sold under the ALKAFLO® brand name. As noted on page 5 of the European patent, a small amount, such as 0.1, of sodium gluconate or other suitable sequestering agent, may be added to the formulations to prevent the formation of precipitates caused by impurities in the water or chemicals used.

The disclosure and use of this liquid phosphate alkaline buffer that worked well with reactive dyes ushered in a search for similarly effective, easily handled alkaline buffers that did not require a significant amount of environmentally detrimental phosphate-containing ingredients.

U.S. Pat. No. 5,242,466 (Aseervatham et al.) discloses an alkali composition containing a mixture of potassium silicate and potassium hydroxide for use in dyeing cellulosic fabrics with reactive dyes. The patent discloses that in conventional reactive dyeing processes, a sequestering agent is usually added to the dye bath "in order to mop up cations which might adversely affect the dyeing process by forming insoluble dye precipitates, such as calcium, magnesium, iron and copper." Among the typical sequestering agents named are ethylenediaminetetraacetic acid (EDTA) sodium salt, ethylenediamine tetra-bis phosphonic acid (EDTP) (also known as ethylenediaminetetra(methylenephosphonic acid) (EDTMP)) (commercially available as MASQUEL® P430 Ma from Protex Limited, and as DEQUEST® from Monsanto Company), nitrilotriacetic acid (NTA) sodium salt, phosphonic acid esters and sodium gluconate. For the potassium silicate, potassium hydroxide alkali donor composition described in the patent, the sequestrant is optional and may be used in amounts of 0–20 wt %, more preferably 1–10 wt % (column 2, lines 29–40). It is now recognized that the use of silicates also poses problems, particularly with respect to precipitation in the presence of metals which can cause equipment build-up and spotting on the fabric. Sequestrants would prevent this precipitation and are recommended for this specific problem.

U.S. Pat. No. 5,382,262 (Moore) describes a liquid alkali composition for use in reactive dyeing of cotton and cotton blended fabrics, the composition being a mixture of potassium hydroxide and potassium carbonate made by a particular reaction and optionally containing sodium citrate and polyacrylic acid. An excess of the carbonate is used to obtain a 2 wt % pH greater than about 12 and a difference between Total Alkalinity and Active Alkalinity of about 11. "Active Alkalinity" is the amount of alkali titratable with strong acid to a phenolphthalein endpoint, that basically indicates the amount of free hydroxide. "Total Alkalinity" is the amount of alkali titratable with strong acid to a methyl orange endpoint, that basically indicates the amount of free hydroxide plus carbonate, and is an indication of the buffering ability of the composition. The patent discloses that amino, polyphosphate, gluconate, and polymeric chelating agents are possible substitutes for polyacrylic acid whose function is to prevent crystallization and precipitation in the concentrated formulation, but such additives are optional. In the "Background" section, the patent notes that various alkalis have been used to obtain the reaction of different classes of reactive dyes to cellulose fibers, including sodium hydroxide, potassium hydroxide, trisodium phosphate, sodium tripolyphosphate, sodium carbonate, sodium bicarbonate and sodium silicate.

U.S. Pat. No. 5,047,064 (Rizzardi) describes an alkaline composition for the treatment of cellulosic substrates such as cellulosic fibers that results in improved dyeability, e.g., with reactive dyes. The composition is an aqueous liquor containing as an essential component at least 75 wt % of potassium hydroxide and preferably also an alkali metal silicate, a wetting agent and a sequestering agent. The patent states that the sequestering agent is "an alkali-resistant agent capable of sequestering or complexing with heavy metal ions" and states that the preferred compounds are alkali metal salts of hydroxycarboxylic acids, particularly pentonic, hexonic and heptonic acids, and more particularly gluconic acid, especially sodium gluconate. The patent discloses that other compounds for tying up heavy metal ions in aqueous media are known to be useful as cation sequestering agents and include alkali metal glucoheptonates and alkali metal salts of nitrilocarboxylic acids and of EDTA. The metal-sequestering or complexing agent is disclosed as being conveniently added to the treatment liquor in admixture with a dispersing agent, preferably an anionic dispersant.

The sequestering agents of the Rizzardi patent are used to inhibit the formation of less water-soluble metal silicates which might interfere with the removal of the alkali metal silicate during the rinsing of the substrate which follows the alkali treatment step. This is the same usage as found in the Aseervatham et al. patent.

U.S. Pat. No. 4,231,749 (Balland) describes a fabric dyeing method, useful with natural fibers such as cotton or wool and synthetic fibers, in which a phosphonic acid derivative neutralized to a pH of 7 is used as a sequestering agent. It is stated that dyeing quality and efficiency can be reduced by the presence of alkaline earth and heavy metal ions in the dye bath, and that certain dyestuff compounds containing copper, chromium and like metals are demetallized at pH 7 by aminopolycarboxylic acid derivatives, such as EDTA, used as sequestering agents, which can also adversely affect the resulting dye and color characteristics under these lower pH conditions. The phosphonic acid derivatives of Balland are stated to provide excellent sequestration of possible metallic impurities in the dye bath without any tendency towards demetallization of the dyestuff molecule and consequent adverse affect on the color characteristics thereof. Balland's phosphonic acid derivatives are salts of amino-lower-alkane-polyphosphonic acids and/or the salts of hydroxy-lower-alkane phosphonic acids. The DEQUEST® line from Monsanto Company are well-known versions.

The "Background" section and comparative formulations in Examples 1–5 and 7 of Balland disclose the adverse use of unusually large and excessive amounts of aminopolycarboxylic acid derivatives such as EDTA as sequestering agents in dye baths for textile fibers such as cotton fabric. Such sequestering agents are stated to cause a significant demetallization of the dyestuff at lower pHs such as 7 and this is exaggerated by the amounts used, resulting in a significant modification of the nuance, tone and color of the dyeing, and a detrimental effect on the stability of the dyestuff to light. Balland's Examples 1–5 and 7 illustrate the exaggerated use of EDTA as a sequestering agent with dyestuffs known for their sensitivity to sequestering agents, and these Examples report problems with such sequestrants and better results with the phosphonic acid derivatives disclosed in this patent. Thus, Balland teaches away from the use of aminopolycarboxylic acid derivatives, such as EDTA, as sequestrants for reactive dyeing processes.

Other technical literature, notably an August 1995 Monsanto Company "Technical Update" entitled *Chelation*, teaches away from using EDTA under strong alkaline conditions, such as above pH 11, because under such conditions, EDTA is not as effective in sequestering metals as at neutral and mildly alkaline pHs.

Many other references disclose various compositions containing diverse components used as alkali auxiliaries for reactive dyes. However, none of them appears to be based upon the discovery that led to the present invention. The present inventors discovered that the reason that tramp metal ions interfere with reactive dyeing is that the tramp ions catalyze or otherwise promote hydrolysis of the reactive dyes, and especially the more reactive ("hot") dyes, although the precise mechanism is not yet known. Based on this discovery, the present invention provides an aqueous alkali composition capable of deactivating the tramp metal ions and reducing hydrolysis of the reactive dyes before they can react with the reactive groups of the fabric being dyed. Unlike Balland U.S. Pat. No. 4,231,749, which demonstrated that the use of aminopolycarboxylic acid derivatives such as EDTA, when applied at a neutral pH, led to poor light fastness and other adverse dyeing effects, the present invention does not use a sequestrant such as EDTA to prevent precipitation of dyes and prevent dye shade changes. Rather, the present invention is directed to reducing reactive dye hydrolysis using aminopolycarboxylates (hereinafter "APCs"), such as EDTA, in a highly alkaline aqueous solution. Unexpectedly, particularly in view of the detrimental effects reported in the Balland patent due to the use of EDTA, the present inventors determined that EDTA and related APCs do not adversely affect even premetallized reactive dyes when applied in the highly alkaline composition of the present invention. Thus, with the present invention, APC applied from basic solution will both reduce destructive reactive dye hydrolysis and will not adversely affect even premetallized reactive dyes.

The present invention allows very effective reaction of reactive dyes on fabrics susceptible to reactive dyeing, especially cellulosic fabrics. Moreover, the alkali composition of the present invention is formulated to be free of phosphates and silicates and therefore is of significant value because it allows non-phosphate and non-silicate formulations to function as well as phosphated formulations or soda ash. Such formulations are becoming more valued as addition of phosphates to the environment is contraindicated, and the detrimental effect of silicates on equipment and dyed fabrics is likewise contraindicated.

BRIEF SUMMARY OF THE INVENTION

One aspect of the present invention relates to a phosphate-free and silicate-free aqueous alkali composition consisting essentially of water, a water soluble base selected from the group consisting essentially of alkali metal hydroxide, alkali metal carbonate and mixtures thereof, wherein the base is present in an amount sufficient to yield a composition pH of about 11 to about 12 at a composition concentration of about 0.1 wt % to about 1.0 wt % in a dye bath, and an aminopolycarboxylate sequestrant in an amount sufficient to sequester metal ion impurities and prevent destructive reactive dye hydrolysis when the composition is used to dye fabric in the presence of reactive dye and metal ion impurities.

Another aspect of the present invention relates to an aqueous dye bath, containing metal ion impurities, for dyeing a fabric, the dye bath comprising a reactive dye, a neutral salt present in an amount effective for salting out the dye on the fabric, and a phosphate-free and silicate-free alkali composition for promoting reaction of the dye on the fabric, the alkali composition consisting essentially of a water soluble base selected from the group consisting of alkali metal hydroxide, alkali metal carbonate and mixtures thereof, wherein the base is present in an amount sufficient to yield a dye bath pH of about 11 to about 12 at an alkali composition concentration of about 0.1 wt % to about 1.0 wt % in the dye bath, and an aminopolycarboxylate sequestrant in an amount sufficient to sequester the metal ion impurities and prevent destructive reactive dye hydrolysis in the dye bath.

Still another aspect of the present invention relates to a method for dyeing a fabric capable of being dyed with a reactive dye to color the fabric, the method comprising the steps: (a) providing an aqueous dye solution containing metal ion impurities and comprising the reactive dye, a neutral salt in an amount sufficient to cause enough of the dye to be absorbed by the fabric to color the fabric, and a phosphate-free, silicate-free aqueous alkali composition in an amount sufficient to promote reaction of the absorbed dye on the fabric, resulting in the absorbed dye being covalently bonded to the fabric and the fabric being colored, the aqueous alkali composition consisting essentially of a water soluble base selected from the group consisting of alkali metal hydroxide, alkali metal carbonate and mixtures thereof, wherein the base is present in the dye solution in an amount sufficient to yield a dye bath pH of about 11 to about 12 at a composition concentration of about 0.1 wt % to about 1.0 wt % in the dye bath, and an aminopolycarboxylate sequestrant in an amount sufficient to sequester the metal ion impurities and prevent destructive reactive dye hydrolysis in the dye bath; and (b) contacting the fabric with the dye solution under conditions sufficient to dye the fabric.

DETAILED DESCRIPTION OF THE INVENTION

As noted above, the present invention relates to an aqueous alkali composition consisting essentially of water, a water-soluble base containing alkali metal hydroxide, alkali metal carbonate or mixtures thereof, where the base yields an alkaline auxiliary composition pH of about 11 to about 12 when used in a concentration of about 0.1 wt % to about 1.0 wt % in a dye bath. An essential component of the alkali composition is an aminopolycarboxylate (APC) sequestrant in an amount sufficient to sequester the fortuitous metal ion impurities and prevent destructive reactive dye hydrolysis. Dye baths and methods using the alkali composition for reactive dyeing are also within the scope of the invention.

Although any fabric which is susceptible to reactive dyeing may be dyed using the composition of the present invention, the preferred fabrics are cellulosic fabrics, such as cotton, rayon and tencel, and particularly those containing cotton in any amount. Thus, the preferred fabrics are cotton fabrics containing from about 5 wt % to 100 wt % cotton.

As used herein, the terms "percent", "%," "weight percent" and "wt %" all mean the percentage by weight of the indicated component or ingredient within the product or composition in which it is present, without dilution, unless otherwise indicated by the context in which the term is used.

Any dyestuffs susceptible to dyeing by reactive dyes may be used. A great many reactive dyes are known for dyeing fabrics, particularly cellulosics, virtually any color in the spectrum. They are readily available from a number of commercial sources.

The reactive dyes may have various types of reactive functions. By way of example and not limitation, reactive dyes having the following reactive functions are readily available: Dichlorotriazine (DCT) types of dyes are available from ICI Americas Inc. under the brand name PROCION® MX. Monochlorotriazine (MCT) types of dyes are available from Ciba-Geigy Corp. under the brand names CIBACRONE and CIBACRON® E; from ICI Americas Inc. under the brand name PROCION® HE; and from Sandoz Corp. under the brand name DRIMAREN® P. Vinyl sulfone (VS) types of dyes, are available from Hoechst Celanese Corp. under the brand name REMAZOL® and from Sumitomo Corp. of America under the brand name SUMIFIX®. Trichloropyrimidine (TCP) types of dyes are available from Sandoz Corp. under the brand name DRIMAREN® Z and from Ciba-Geigy Corp. under the brand name CIBACRON® T-E. Dichloro-quinoxaline (DCQ) types of dyes are available from Bayer Corp. under the brand name LEVAFIX® E. Difluorochloro-pyrimidine (DFCP) types of dyes are available from Bayer Corp. under the brand names LEVAFIX® E-A. Monofluorotriazine (FT) types of dyes are available from Ciba-Geigy Corp. under the brand name CIBACRON® F and from Bayer Corp. under the brand name LEVAFIX® E-N. Fluorochloromethyl pyrimidine types of dyes are available from Bayer Corp. under the brand name LEVAFIX® PN. Phosphonic acid types of dyes are available from ICI Americas Inc. under the brand name PROCION® T.

Reactive dyes may also include multifunctional reactive dyes in which the dyes contain more than one reactive group, which enhances their reaction with and co-valent bond to the fabric substrate. Thus, if more than one reactive group is available on a dye, the dye is more likely to react with and bond to the many available alkoxide or hydroxy groups of the substrate. Multifunctional reactive dyes are comparatively expensive, however. While they can be used with the present invention, the enhanced dye yield associated with multifunctional reactive dyes can be obtained using the alkali auxiliary composition of the present invention with the less expensive unifunctional reactive dyes.

The chromophore portion of the dye may be any colored species meeting the appropriate requirements for fastness, solubility, tinctorial value, ecology and economy. Azo dyes comprise the majority, with anthraquinone and phthalocyanine comprising most of the other blue dyes. Metallized (sometimes referred to as "premetallized") and formazan dyes are also important blue dyes. Other blue dyes are oxazine and thiazine dyes. Yellow dyes are generally monoazo and most have pyrazolone or pyridone couplings. Orange dyes are generally monoazo derived from couplings to pyrazolones or of slightly substituted phenyl and napthyl groups. Many red dyes are based on H-acid, while others are substituted phenyl and napthyl or metallized systems. Violet dyes are also metallized monoazo dyes. Brown and black dyes generally are disazo with some exceptions for metallized or polycyclic structures. Green dyes are obtained by bridging an antraquinone blue chromogen with a yellow chromagen, or from phthalocyanine.

Dyes having these reactive groups and chromophores are disclosed, for example in *Kirk-Othmer Chemical Encyclopedia*, Third Edition, 8:689–697 and 809–838 (1989), the disclosures of which, together with the disclosures of the references cited therein, are hereby incorporated herein by reference. One skilled in the art could readily make the appropriate selection from the vast number of reactive dyes that are available for use, without undue experimentation, with the alkali composition of the present invention.

Table 3 at page 819 of the *Kirk-Othmer Encyclopedia of Chemistry*, supra, illustrates the structure of the reactive groups attached by a bridging group to the rest of the dye molecule (chromophore). Reactivity on an arbitrary scale is rated from 1 to 5, with 5 being the most reactive. The more reactive the dye, the more susceptible it is to hydrolysis. Those dyes with a relative reactivity of 5 would be expected to be interactive with trace transition metals, especially iron salts known to be active Friedel-Crafts catalysts. The inactivation of such iron salts according to the present invention by aminopolycarboxylate sequestrants is critical to reducing hydrolysis to acceptable levels.

Tramp metal ions that are believed to be responsible for catalysis or other promotion of destructive hydrolysis of reactive dyes are metal ions capable of interacting with the reactive function of the dyes. Typical tramp metal ions sequestered by the composition of the present invention are iron, zinc, copper, cobalt, nickel and aluminum, among other transition metals. These or other tramp metal ions are usually present and tend to be unavoidable in water sources or other chemicals used in the reactive dye solutions or in the fabrics.

The alkali auxiliary composition of the present invention is free of phosphates and silicates The composition consists essentially of water, a water soluble base having the components described below, and at least one aminopolycarboxylate sequestrant.

The water soluble base consists essentially of alkali metal hydroxide, alkali metal carbonate and mixtures thereof. The preferred alkali metal hydroxides are potassium hydroxide (KOH), sodium hydroxide (NaOH), and cesium hydroxide (CsOH), with KOH and NaOH being more preferred on the basis of cost and ready availablility from a large number of commercial sources.

The preferred alkali metal carbonate is potassium carbonate ($K_2CO_3$), although other water soluble alkali metal carbonates may be used, such as rubidium carbonate ($Rb_2CO_3$) and cesium carbonate ($Cs_2CO_3$). For practical purposes and in view of economics, potassium carbonate is presently most preferred.

The alkali metal hydroxide(s) and/or carbonate(s) are present in the composition in amounts to provide the composition with a pH of about 11 to about 12 at a concentration of about 0.1 wt % to about 1.0 wt %, and preferably, about 0.2 wt % to about 0.6 wt %, the desired concentrations of the composition used in a dye bath or dye solution. The preferred combinations of components of the water soluble base component are potassium hydroxide and potassium carbonate, and sodium hydroxide and potassium carbonate.

Any amounts of the hydroxide and/or carbonate components of the water soluble base may be present, as long as the composition has a pH of about 11 to about 12 at a concentration of about 0.1 wt % to about 1.0 wt %, and preferably about 0.2 wt % to about 0.6 wt %, the concentration used in the dye bath or dye solution resulting in the dye bath having the same pH. In general, it is preferred to use more hydroxide than carbonate, due to economic considerations. The hydroxides allow for obtaining a higher pH with less material.

The preferred alkali metal hydroxide is NaOH and this component may be used in the water soluble base component in an amount, based on the alkali auxiliary composition, of about 3 wt % to about 40 wt %, preferably in an amount of about 5 wt % to about 10 wt %, and more preferably in an amount of about 6 wt % to about 8 wt %.

Potassium hydroxide can be substituted for sodium hydroxide on a molar basis. Thus, potassium hydroxide may be present in an amount, based on the alkali auxiliary composition, of about 4 wt % to about 56 wt %, preferably in an amount of about 7 wt % to about 14 wt %, and more preferably, about 10 wt % to about 12 wt %.

The preferred alkali metal carbonate is potassium carbonate and this component may be used in the water soluble base component in an amount, based on the alkali auxiliary composition, of about 19 wt % to about 39 wt %, preferably in an amount of about 24 wt % to about 34 wt %, and more preferably in an amount of about 28 wt % to about 30 wt %.

The sequestrant component of the alkali auxiliary composition may be any APC that prevents destructive hydrolysis of reactive dyes. This includes any aminopolycarboxylate (APC) which ties up the tramp metal ions such that the dyes are not prematurely hydrolyzing, making the dyes less able to form covalent bonds with the alkoxide groups on the cellulosic fabrics at the high pH of about 11 to about 12 of the dye solution or bath.

The APC component of the present invention may have the following structural Formula (I):

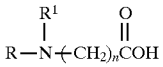

(I)

wherein n is 1 or 2 and

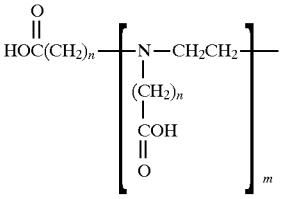

where m is 0–5; and

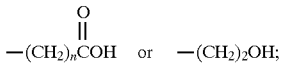

and any soluble salts thereof.

Nonlimiting examples of APC components within the scope of Formula (I) include nitrilotriacetic acid (NTA), N-hydroxyethyliminodiacetic acid (HEDA), ethylenediaminetetraacetic acid (EDTA), N-hydroxyethylethylenediaminetriacetic acid (HEEDTA), diethylenetriaminepentaacetic acid (DTPA), and diaminocyclohexanetetraacetic acid (DCTA), and soluble salts thereof. Other suitable APC sequestrants are likewise commercially available and well known to those skilled in the art.

The presently preferred APC is EDTA, or any of the soluble salts of EDTA, most conveniently, the sodium or potassium salts, and preferably, the sodium salts. Examples are EDTA disodium salt, EDTA dipotassium salts EDTA trisodium salt, EDTA tripotassium salt, EDTA tetrapotassium salt and EDTA tetrasodium salt.

Presently, the best performing, and currently, the most economical APC products are EDTA salts, and particularly the tetrasodium salt of EDTA, available for example as PLEXENE™, extra concentrated, having a 40 wt % concentration of EDTA tetrasodium salt, marketed by Sybron Chemicals Inc.

The APC must be present in the alkali auxiliary composition in an amount sufficient to sequester metal ion impurities, namely, the tramp metal ions, and prevent destructive reactive dye hydrolysis at the concentration the composition is used to dye fabric in the presence of the reactive dye and other components of the dye bath, including the tramp metal ions. As a result, the APC is present in amounts greater than the amount typically present when APC is used for its normal anti-dye precipitation sequestration purposes as disclosed in the prior art. The APC may be used in the alkali auxiliary composition in an amount (calculated on a 100% basis of a free acid, unneutralized form) of about 2 wt % to about 12 wt %, preferably in an amount of about 3 wt % to about 8 wt %, and more preferably in an amount of about 4 wt % to about 7 wt %.

The other essential component in the alkali auxiliary composition of the present invention is water, but it is not necessary that the water be present as a separate additive. Instead, water may be present, in whole or in part, as an ingredient of aqueous solutions of the other components of the composition. The water should be as free as possible, and preferably totally free of impurities, such as phosphates, silicates and tramp metal ions.

In essence, the balance of the composition after subtracting the amounts of the active components and any optional components is water. The amount of water should be limited to what is necessary to afford a stable liquid product.

Since it is intended that the alkali composition be as concentrated as possible consistent with good shelf stability, it is preferred to include a stabilizer capable of retarding precipitation and crystallization of any components or impurities in the composition for a reasonably long, commercially practical shelf life of about 6 months. Various types of stabilizers include, for example without limitation, aminopolyphosphonates, available from Monsanto Company, for example as DEQUEST® chelates, designations 2000 (aminotrimethylenephosphonic acid (ATMP)), 2006 (aminotrimethylenephosphonic acid, pentasodium salt ($Na_5$ATMP)), 2010 (hydroxyethylidene diphosphonic acid (HEDP)), 2016 (hydroxyethylidene diphosphonic acid, tetrasodium salt ($Na_4$HEDP)), 2060 (diethylenetriaminepenta (methylenephosphonic acid) (DTPMP), 2066 (diethylenetriaminepenta(methylenephosphonic acid, hexasodium salt ($Na_6$DTPMP)), among others. Other known crystallization inhibitors are polyvinylpyrrolidone (PVP) and polyacrylic acids.

The stabilizer component, when present (typically available in 50 wt % solutions), should be used in the alkali auxiliary composition in a concentration of about 0.12 wt % to about 0.50 wt % on a 100% basis.

The presently most preferred type of stabilizer is DTPMP in an amount sufficient to prevent destructive precipitation of the EDTA and any other components of the auxiliary composition. This stabilizer is available commercially, for example in a concentration of 50 wt %, as DEQUEST® 2060, marketed by Monsanto Company.

Other additives and adjuvants that do not adversely affect the performance of the alkali composition as a reactive dye auxiliary may be used as desired. Such optional ingredients include for example, without limitation, thickeners, wetting agents, deaerators, defoamers, dye bath lubricants, and the like. All of such additives or adjuvants are well known to those skilled in the art and further details about the type of such additives, the amounts in which they are used and their method of inclusion within the alkali composition of the present invention or the dye bath containing it, need not be explained in detail herein.

The alkali auxiliary composition of the present invention may be made by simply mixing the components in a suitable vessel using readily available equipment. There is no criticality regarding the order in which the ingredients or components are added, the addition rates, temperatures or other manufacturing parameters, except that, if used, the APC (if in free acid form) should be pre-neutralized prior to being mixing into the composition. Thus, one skilled in the art could readily make the alkali auxiliary composition of the present invention by taking into account available equipment and typical processing parameters.

The preparation of the alkali auxiliary composition of the present invention will now be described in more detail by reference to the following specific, non-limiting Example 1, which in Table 1 sets forth several different formulations (in wt %) suitable for promoting reaction of the reactive dye on cellulosic fabric, for instance.

EXAMPLE 1

TABLE 1

| | Sample No. | | | | | |
|---|---|---|---|---|---|---|
| Ingredient | A | B | C | D | E | F |
| EDTA (100%) | 7.0 | 6.5 | 6.5 | — | — | — |
| KOH (45%) | 23.0 | 29.0 | — | — | — | — |
| WATER | 70.0 | — | — | 1.35 | 2.0 | 1.3 |
| $K_2CO_3$ (47%) | — | 64.5 | 64.5 | 62.5 | 62.5 | 62.5 |
| CsOH (50%) | — | — | 29.0 | — | — | — |
| NaOH (50%) | — | — | — | 14.5 | 14.5 | 14.7 |

TABLE 1-continued

| Ingredient | Sample No. A | B | C | D | E | F |
|---|---|---|---|---|---|---|
| PLEXENE ® extra conc. (40% EDTA, tetra-sodium salt) | — | — | — | 21.65 | 21.0 | 21.0 |
| DEQUEST ® 2060 (50% DTPMPA) | — | — | — | — | — | 0.5 |

As noted above, the reactive dye to be used with the present invention may be any reactive dye, including any metal-containing reactive dye sensitive to demetallization.

The alkali auxiliary composition of the present invention may be used by being mixed in an aqueous dye solution with all of the conventional ingredients of a dye solution for reactive dyeing in a manner well known to those skilled in the art, and contacting the fabric to be dyed under well-known conditions sufficient to covalently bond the dye to the fabric.

The method of dyeing a fabric according to the present invention generally comprises the steps: (a) providing an aqueous dye solution containing metal ion impurities and comprising the reactive dye, a neutral salt in an amount sufficient to cause enough of the dye to be absorbed by the fabric to color the fabric, and a phosphate-free, silicate-free aqueous alkali composition in an amount sufficient to promote reaction of the absorbed dye on the fabric, resulting in the absorbed dye being covalently bonded to the fabric and the fabric being colored, the aqueous alkali composition consisting essentially of a water soluble base selected from the group consisting of alkali metal hydroxide, alkali metal carbonate and mixtures thereof, wherein the base is present in the dye solution in an amount sufficient to yield a dye bath pH of about 11 to about 12 at a composition concentration of about 0.1 wt % to about 1.0 wt %, and preferably 0.2 wt % to about 0.6 wt %, in the dye bath, and an aminopolycarboxylate sequestrant in an amount sufficient to sequester the metal ion impurities and prevent destructive reactive dye hydrolysis in the dye bath; and (b) contacting the fabric with the dye solution under conditions sufficient to dye the fabric.

The dye bath of the present invention can be applied to a fabric by various methods well known to those skilled in the art, such as by spraying, foam application, padding or immersion, for example. More particularly, applications methods known to those skilled in the art are typically characterized as an all-in method, continuous dyeing, cold pad-batch dyeing, cold exhaust dyeing, warm or hot exhaust dyeing and migration exhaust technique for less than 0.5% depth of shade, for example. These techniques are generally described in the *Kirk-Othmer Encyclopedia of Chemistry,* 3rd Edition, 8:693–694 (1989). Variations of reaction conditions may be undertaken without undue experimentation by those skilled in the art using available equipment and typical processing parameters. The preferred application is by immersion.

The use, advantages and benefits of the present invention comprising the alkali auxiliary composition, a dye bath containing the composition and the use of the dye bath in reactive dyeing of cotton-containing fabric, will now be described in more detail by reference to the following specific, non-limiting Examples 2–11.

All dyeings in the Examples were done using a stainless steel laboratory dyeing apparatus, Model WGRG-5 from Ahiba A. G., Basel, Switzerland, using 5 grams (g) of 100% cotton knit fabric that was bleached and neutralized. The liquor/fabric ratio for all Examples was 20:1, with a liquor content of 100 g.

Since this invention deals with a reduced hydrolysis dyeing reaction mechanism, most of the examples include an "ACS Yield" reading. This number is determined using an "Applied Color System" Spectro Sensor® II instrument, Model 1400 PC, from Applied Color Systems, Inc., Princeton, N.J., which measures depth of shade only, which is related to the amount of dye affixed to the fiber. The higher the ACS yield, the more dye is bonded to the fabric. This number does not reflect other factors which are also critical to color perception, such as cast (is it too red or too blue, etc.) and brightness (is it eye-catching or dull).

Where the ACS Yield does not apply, alternate descriptions of the results are provided.

EXAMPLE 2

Effect of Removal of Tramp Metal Ions on Dyeing

All dyeings used 90 g/liter (L) Glauber's salt (9 g) and followed the following procedure:

Step 1: Set dye bath at 100° F. with fabric, water, dyes and salt. Run 10 minutes.

Step 2: Raise temperature to 175° F. (about 3° F./min.). Run 15 minutes.

Step 3: Add alkali and run 45 minutes.

Step 4: Rinse, soap, rinse and dry.

Step 5: Evaluate shade.

| | Component | Amount (g) |
|---|---|---|
| Run A: Industry Standard Alkali | | |
| Dye: | Procion ® Green HE-4BD (1.12% based on weight of fabric (owf)) | 0.056 |
| | Procion ® Red HE-3B (0.463% owf) | 0.023 |
| | Procion ® Yellow HE-4R (1.22% owf | 0.061 |
| Alkali: | Soda Ash (20 g/L) | 2 |
| Visual observations - Shade: olive | | |
| Run B: Alkali is typical, non-phosphate liquid buffer | | |
| Dyes and Glauber's salt are the same and are used in the same amounts as in Run A. | | |
| Alkali: | Alkaflo ® LSA (Alkaline carbonate solution; Sybron Chemicals Inc.) (5 g/L) | 0.5 |
| Visual observations - Shade: Green, considerably less red than Run A. | | |
| Run C: Alkali is same as in Run B, but demetallized. | | |

The fabric was demetallized with Dowex® 50X2-100 ion exchange resin by soaking it for 1 hour in a 6N HCl solution, recirculating the solution through both the fabric and ion exchange resin (Dowex® 50 strong cation exchanger), and then rinsing the fabric with neutral deionized water.

Dyes and salt are the same and are used in the same amounts as in Run A.

| | Component | Amount (g) |
|---|---|---|
| Alkali: | Alkaflo ® LSA (demetallized using an ion-exchange column) (5 g/L) | 0.5 |
| Visual observations - Shade: Olive, identical to Run A | | |
| Run D: Alkali is Alkali Auxiliary Composition of the Present Invention | | |
| Dyes and salt are the same and are used in the same amounts as in Run A. | | |
| Alkali: | Example 1, Table 1, Sample D (5.0 g/L) | 0.5 |
| Visual observations - Shade: Olive, identical to Run A | | |

Conclusions

This Example demonstrates that removal of all tramp metal ions, either by using ion exchange resins on the solutions prior to dyeing (Run C) or by the use of the levels of EDTA in the alkali composition of this invention (Run D), yields shades that are equivalent to those achievable with sodium carbonate (soda ash), the industry standard (Run A). Both the soda ash standard alkali and the alkali with EDTA of this invention work by the total removal or sequestration of metal from the dyeing. The soda ash removes the tramp metal ions by precipitation. The EDTA removes the tramp metal ions by sequestering them in solution. Comparing Runs A and D to Run C, which is demetallized, produces the same shade of olive. However, Run B, using a normal liquid buffer system, results in a variation of shade, even though the liquid buffer system is well known and accepted in the industry.

EXAMPLE 3

Demonstration that the Presence of Sequestrant at the Levels of this Invention Protects Dyes from Hydrolysis The following are common to all runs of Example 3:

Procedure:

Step 1: Mix water, dye, Glauber's salt (90 g/L, here 9 g) and alkali, set temperature at 100° F.

Step 2: Raise temperature to 210° F. (about 3° F./min.). Run 3 minutes.

Step 3: Cool to 100° F. (as quickly as possible) and add fabric.

Step 4: Heat to 175° F. (about 3° F./min.) and run 45 minutes.

Step 5: Rinse, soap, rinse and dry.

Step 6: Determine ACS Yield.

Run A:

| Component | Amount (g) Sample No. 1 | 2 | 3 | 4 | 5 |
|---|---|---|---|---|---|
| Procion ® Yellow HE-R (3% owf) | 0.15 | 0.15 | 0.15 | 0.15 | 0.15 |
| Soda Ash (20 g/L) | 2 | — | — | — | — |
| Alkaflo ® LSA (5 g/L) | — | 0.5 | — | — | — |
| Alkaflo ® PFP (Alk.Phosphate: Sybron Chemicals Inc.) (4–5 g/L) | — | — | 0.4 | 0.5 | — |
| Example 1, Table 1, Sample F (5 g/L) | — | — | — | — | 0.5 |
| ACS Yield | 100 | 96 | 81 | 67 | 104 |

Run B:

| Component | Amount (g) Sample No. 6 | 7 | 8 | 9 | 10 |
|---|---|---|---|---|---|
| Procion ® Red HE-3B (3% owf) | 0.15 | 0.15 | 0.15 | 0.15 | 0.15 |
| Soda Ash (20 g/L) | 2 | — | — | — | — |
| Alkaflo ® LSA (5 g/L) | — | 0.5 | — | — | — |
| Alkalfo ® PFP (4–5 g/L) | — | — | 0.4 | 0.5 | — |
| Example 1, Table 1, Sample F (5 g/L) | — | — | — | — | 0.5 |
| ACS Yield | 100 | 85 | 91 | 81 | 98 |

-continued

Run C:

| Component | Amount (g) Sample No. 11 | 12 | 13 | 14 | 15 |
|---|---|---|---|---|---|
| Procion ® Green HE-4BD (3% owf) | 0.15 | 0.15 | 0.15 | 0.15 | 0.15 |
| Soda Ash (20 g/L) | 2 | — | — | — | — |
| Alkaflo ® LSA (5 g/L) | — | 0.5 | — | — | — |
| Alkaflo ® PFP (4–5 g/L) | — | — | 0.4 | 0.5 | — |
| Example 1, Table 1, Sample F (5 g/L) | — | — | — | — | 0.5 |
| ACS Yield | 100 | 126 | 101 | 71 | 142 |

Run D:

| Component | Amount (g) Sample No. 16 | 17 | 18 | 19 | 20 |
|---|---|---|---|---|---|
| Procion ® Turquoise HA (3% owf) | 0.15 | 0.15 | 0.15 | 0.15 | 0.15 |
| Soda Ash (20 g/L) | 2 | — | — | — | — |
| Alkaflo ® LSA (5 g/L) | — | 0.5 | — | — | — |
| Alkaflo ® PFP (4–5 g/L) | — | — | 0.4 | 0.5 | — |
| Example 1, Table 1, Sample F (5 g/L) | — | — | — | — | 0.5 |
| ACS Yield | 100 | 109 | 90 | 67 | 115 |

Conclusion

In each case, Samples 5, 10, 15 and 20 based on the present invention protected the dye from hydrolysis substantially equally as well (Sample 10) or substantially better (Samples 5, 15 and 20) than the soda ash standard (Samples 1, 6, 11 and 16), and significantly better than the current liquid alkali buffers (Samples 2, 3, 4, 7, 8, 9, 12, 13, 14, 17, 18 and 19). This judgment was made based on the high ACS Yield readings for dyeings done with the alkali composition of the present invention corresponding to Example 1, Table 1, Sample F. The composition of the present invention was shown to be effective, even though the dye procedure of this Example was altered, compared to Example 2, to allow the dyes more time to be damaged by hydrolysis before the fabrics were introduced.

EXAMPLE 4

Comparison of APC and Phosphate Sequestrants

All dyeings involved 3% owf Procion® Red HE-3B dye (0.15 g), 90 g/L Glauber's salt (9 g) and 5 g/L of Alkaflo® LSA (0.5 g). All dyeings used the following procedure:

Step 1: Set temperature of the water, fabric and salt mixture at 100° F.

Step 2: Raise temperature to 175° F. (about 3° F./min.). Run 15 minutes.

Step 3: Add alkali.

Step 4: Run 45 minutes at 175° F.

Step 5: Rinse, soap, rinse and dry.

Step 6: Determine ACS Yield.

| Buffer/Sequestrant mixture | Amount (g) Dyeing Run A | B | C | D |
|---|---|---|---|---|
| Biquest ® 543-45AS (Phosphonate; Albright & Wilson Americas, Ashland, VA) (30 wt % solids) (1 g/L) | — | 0.1 | — | — |
| Sodium gluconate (30 wt % solids) (1 g/L) | — | — | 0.1 | — |
| EDTA (22 wt % solids) (1.4 g/L) | — | — | — | 1.4 |
| Alkaflo ® LSA (5 g/L) | 0.5 | 0.5 | 0.5 | 0.5 |
| ACS Yield | 100 | 104 | 106 | 122 |

Conclusions

The Alkalfo® LSA test, Run A, represents a standard nonphosphate buffer system. Comparison to the other dyeing ACS Yields indicates that any sequestrant added to the dye bath containing the carbonate buffer (Runs B, C and D) will offer advantages, but that EDTA (Run D) improved performance over phosphonates (Run B) and gluconates (Run C). Moreover, Run D, using the present invention, had a significantly improved ACS Yield compared to all of the other samples.

EXAMPLE 5

Observing Improvements With Sequestrant Used on a Cibacron® Dye

All dyeings involved 80 g/L Glauber's salt (8 g) and 3% owf Cibacron® Blue FGFN (0.15 g). All dyeings followed this procedure:

Step 1: Premix water, dyes, and salt. Add fabric, set temperature at 80° F., hold ten minutes with mixing.

Step 2: Add alkali buffer (over 10 minute period) Run 10 minutes.

Step 3: Raise temperature to 140° F. (about 3° F./min). Run 45 minutes.

Step 4: Rinse, soap, rinse and dry.

Step 5: Determine ACS Yield.

| Chemical | Amount (g) Dyeing Run A | B | C | D |
|---|---|---|---|---|
| Soda Ash (10 g/L) | 1 | — | — | — |
| Alkaflo ® LSA (3–5 g/L) | — | 0.3 | 0.4 | 0.5 |
| Alkaflo ® PFP | — | — | — | — |
| Example 1, Table 1, Sample B | — | — | — | — |
| ACS Yield | 100 | 102 | 98 | 97 |

| Chemical | Amount (g) Dyeing Run E | F | G | H | I | J |
|---|---|---|---|---|---|---|
| Soda Ash | — | — | — | — | — | — |
| Alkaflo ® LSA | — | — | — | — | — | — |
| Alkaflo ® PFP (3–5 g/L) | 0.3 | 0.4 | 0.5 | — | — | — |
| Example 1, Table 1, Sample B (3–5 g/L) | — | — | — | 0.3 | 0.4 | 0.5 |
| ACS Yield | 97 | 96 | 95 | 104 | 99 | 99 |

Conclusion

Based on the improvements in the ACS Yield (from a comparison of Runs B, E and H, a comparison of Runs C, F and I and a comparison of Runs D, G and J) the present invention (runs H, I and J) offers a performance consistently closer to that of soda ash than when alkaline carbonate (runs B, C and D) or phosphate (Runs E, F and G) is used alone. Also, the downward trends in ACS Yields in Runs B, C and D and then in Runs E, F and G compared to the same ACS Yield of Runs I and J indicate that excessive use of even the best available liquid alkalis can damage dyes to a small but measureable extent, while excessive use of an alkali containing an APC does not.

EXAMPLE 6

Improvement in Dye Building

All runs used Procion® Red HE-3B dye at 4% owf (0.2 g), and 100 g/L Glauber's salt (10 g).

All dyeings used the following procedure:

Step 1: Set bath at 100° F. with water, fabric, dyes and salt, run 10 minutes.

Step 2: Raise temperature to 175° F. (about 3° F./min.). Run 15 minutes. Add Alkali.

Step 3: Maintain at 175° F. and leave for times specified below.

Step 4: Rinse, soap, rinse and dry.

Step 5: Determine ACS Yield.

| Chemical | Amount (g) Dyeing Run A | B | C | D | E |
|---|---|---|---|---|---|
| Alkaflo ® PFP (5 g/L) | 0.5 | 0.5 | 0.5 | 0.5 | 0.5 |
| Sequestrant | — | — | — | — | — |
| Time (minutes) | 30 | 45 | 60 | 75 | 90 |
| ACS Yield | 99 | 100 | 103 | 104 | 104 |

| Chemical | Amount (g) Dyeing Run F | G | H | I | J |
|---|---|---|---|---|---|
| Example 1, Table 1, Sample F(5 g/L) | 0.5 | 0.5 | 0.5 | 0.5 | 0.5 |
| Time (minutes) | 30 | 45 | 60 | 75 | 90 |
| ACS Yield | 100 | 105 | 108 | 109 | 110 |

Conclusions

In comparison to a standard phosphate buffer system for which the ACS Yields rise from 99 to 104 but level off at 104 (Runs A–E), the composition of this invention (Runs F–J) allows the fabric to continue to accept more and more dye as time goes on. The ACS Yields begin at 100 and continue to improve to 110 at 90 minutes. The level of APC sequestering agent is protecting the dyes from hydrolysis, permiting more efficient, economical use of dyes.

EXAMPLE 7

Investigation of the Use of Less Glauber's Salt With Sequestrant-containing Mixtures Common to all the dyeings in the example is the use of Procion® Red HE-3B at 3% owf (0.15 g).

Procedure for all dyeings:

Step 1: Add water, fabric, dye and salt, heat to 100° F. and run 10 minutes.

Step 2: Raise temperature to 175° F. (about 3° F./min.) and run 15 minutes, add alkali.

Step 3: Run 45 minutes.

Step 4: Rinse, soap, rinse and dry.

Step 5: Determine ACS Yield.

| Chemical | Amount (g) Dyeing Run A | B | C | D | E | F | G | H | I | J | K |
|---|---|---|---|---|---|---|---|---|---|---|---|
| Glauber's Salt (9-5 g/L) | 9 | 8 | 7 | 9 | 8 | 7 | 9 | 8 | 7 | 5 | 5 |
| Soda Ash (20 g/L) | 2 | 2 | 2 | — | — | — | — | — | — | — | — |
| Alkaflo ® LSA (5 g/L) | — | — | — | 0.5 | 0.5 | 0.5 | — | — | — | 0.5 | — |
| Example 1, Table 1, Sample B (5 g/L) | — | — | — | — | — | — | 0.5 | 0.5 | 0.5 | — | 0.5 |
| ACS Yield | 100 | 100 | 97 | 81 | 78 | 73 | 99 | 97 | 94 | 51 | 77 |

Conclusion

Dyeing Runs A, B and C show little if any change in ACS Yield as the Glauber's salt level is lowered when soda ash, at ideal levels, is used. Dyeing Runs D, E and F show that the dye ACS Yield, low to begin with, drops more rapidly with changing Glauber's salt level when an alkaline carbonate liquid buffer is used. Dyeing Runs G, H and I indicate that when EDTA is blended into the alkaline/carbonate buffer according to the present invention, the ACS Yield is better to begin with (nearly that of the ideal soda ash system) and is much less sensitive to lowering levels of Glauber's salt. These results evidence that the use of sequestrants according to the present Invention will allow reductions in the Glauber's salt requirements.

EXAMPLE 8

Sequestrant/Carbonate Buffer with Remazol® Dyes

Common to all dyeings in this example are the use of 3% owf Remozol® Blue RW dye (copper premetallized dye) (0.15 g) and 50 g/L Glauber's Salt (5 g).

Procedure:

Step 1: Set temperature at 80° F. with water, fabric, dyes and salt. Run 10 minutes.

Step 2: Add alkali—run 10 minutes.

Step 3: Raise temperature to 140° F. Run 45 minutes.

Step 4: Rinse, soap, rinse and dry.

Step 5: Determine ACS Yield.

| Chemical | Amount (g) Dyeing Run A | B | C | D | E | F | G | H |
|---|---|---|---|---|---|---|---|---|
| Soda Ash (20 g/L) | 2 | — | — | — | — | — | — | — |
| Alkaflo ® LSA (4–5 g/L) | — | 0.4 | 0.5 | — | — | — | — | — |
| Alkaflo ® PFP (4–5 g/L) | — | — | — | 0.4 | 0.5 | — | — | — |
| Example 1, Table 1, Sample B (4–6 g/L) | — | — | — | — | — | 0.4 | 0.5 | 0.6 |
| ACS Yield | 100 | 104 | 102 | 108 | 103 | 98 | 105 | 106 |

Conclusions

The alkali of the present invention, in the form of a carbonate/sequestrant blend of Example 1, Table 1, Sample B, is safer to use with Remazol® dyes. Dyeing Runs B and C, show reduction in ACS Yield with increasing Alkaflo® LSA. Dyeing Runs D and E show also reduction in ACS Yields with increasing Alkaflo® PFP. However, dyeing Runs F, G and H show improved ACS Yields with increasing levels of the composition of the present invention. Therefore, accidental overuse will have beneficial effects rather than damaging effects. Also, light-fastness measurements are unaffected and are comparable to dyeings of the same dye with soda ash. The light-fastness determinations were based on visual observations made according to AATCC (American Association of Textile Chemists and Colorists) Test Method 16-1990, using an ATLAS® Weather-Ometer® Model C135 tester (Atlas Electric Devices Co., Chicago, Ill.).

EXAMPLE 9

Comparison of Various Metal Cations Used to Neutralize APC in the Present Invention Common to all the dyeings in this example are the use of 3% owf Procion® Red HE-3B dye (0.15 g) and 90 g/L Glauber's salt (9 g).

Procedure:

Step 1: Mix water, fabric, dye and salt, set temperature at 100° F., run 10 minutes.

Step 2: Raise temperature to 175° F. (about 3° F./min.) Run 15 minutes.

Step 3: Add alkali, run 45 minutes.

Step 4: Rinse, soap, rinse and dry.

Step 5: Determine ACS Yield.

| Chemicals | Amounts (g) Dyeing Run A | B |
|---|---|---|
| Example 1, Table 1, Sample B (using KOH) (5 g/L) | 0.5 | — |
| Example 1, Table 1, Sample C (using CsOH) (5 g/L) | — | 0.5 |
| ACS Yield | 121 | 105 |

Conclusion

The smaller the metal cation used in neutralizing the acid form of the APC sequestrant in the alkali compositions of the present invention, the more effective the composition is in enhancing dye ACS Yield.

EXAMPLE 10

To Demonstrate that with EDTA a Strong Alkali Like KOH can be Controlled to Minimize the Hydrolysis of Reactive Dyes Common to all runs in this example are the use of Glauber's salt 50 g/L (5 g) with 3% owf Remazol® Br Blue R Special (0.15 g) and 100 g/L Glauber's salt (10 g) with 3% owf Remazol® Turquoise RP (0.15g).

The alkalis used have equivalent amounts of KOH.

Procedure:

Step 1: Mix dye, water, salt and alkali at 100° F.

Step 2: Raise temperature (about 3° F./min.) to 40° F. higher than the recommended reaction temperature of the dyes (180° F. for Remazol® Br Blue R Special and 200° F. for Remazol® Turquoise RP).

Step 3: Run 3 minutes.

Step 4: Quickly cool bath to 80° F.

Step 5: Add fabric and run 10 minutes.

Step 6: Raise temperature to reaction level (140° F. for Remazol Br Blue R Special, 160° F. for Remazol Turquoise RP).

Step 7: Run 45 minutes.

Step 8: Rinse, soap, rinse and dry.

Step 9: Determine ACS Yield.

| 3% owf Remazol ® Br Blue R Special | Amount (g) Sample No. | | | |
|---|---|---|---|---|
| | 1 | 2 | 3 | 4 |
| *KOH(45 wt %)/EDTA (Acid) (2 g/L–3 g/L) | 0.2 | 0.3 | — | — |
| KOH (45 wt %) (1.7 g/L–2.55 g/L) | — | — | 0.17 | 0.255 |
| ACS Yield | 100 | 72 | 69 | 52 |

| 3% owf Remazol ® Turquoise RP | Amount (g) Sample No. | | | |
|---|---|---|---|---|
| | 5 | 6 | 7 | 8 |
| *KOH(45 wt %)/EDTA (Acid) (2 g/L–3 g/L) | 0.2 | 0.3 | — | — |
| KOH (45 wt %) (1.7 g/L–2.55 g/L) | — | — | 0.17 | 0.255 |
| ACS Yield | 100 | 89 | 89 | 76 |

*85 wt % KOH (45 wt %) and 15 wt % EDTA (Acid)

Conclusion

Higher ACS Yield means less hydrolysis is occurring. This example shows that KOH by itself (Samples 3, 4, 7 and 8) is not an acceptable alkali. However, the combination of KOH and EDTA according to the present invention (Samples 1, 2, 5 and 6) results in an acceptable ACS Yield. Also to be noted is that the dyes used are copper premetallized, and that the dyeings are not adversely affected by the alkaline EDTA, an APC of the present invention.

EXAMPLE 11

Effect of Using Different APCs

Common to all dyeings in this example are the use of 90 g/L of Glauber's salt (9 g), a "Control Solution" of 5 g/L alkali carbonate mixture (0.5 g) from Example 1, Table 1, Sample F, but without the EDTA, and dyes to give an olive shade dye formulation:

| | | |
|---|---|---|
| Procion ® Green HE-4BD | (1.12%) | (0.056 g) |
| Procion ® Red HE-3B | (0.463%) | (0.23 g) |
| Procion ® Yellow HE-4R | (1.22%) | (0.061 g) |

Procedure

Step 1: Set dye bath at 100° F. with dye, salt and fabric.

Step 2: Run 10 minutes.

Step 3: Raise temperature to 175° F. (about 3° F./min.) and run 15 minutes.

Step 4: Add alkali mixture and chelate.

Step 5: Run 175° F. for 45 minutes.

Step 6: Rinse, soap, rinse and dry.

Step 7: Evaluate shade.

| Dyebath compositions | Amount (g) Dyeing Run | | | | | |
|---|---|---|---|---|---|---|
| | A | B | C | D | E | F |
| Control Solution, Example 1, Table 1 (without EDTA) (5 g/L) | 0.5 | 0.5 | 0.5 | 0.5 | 0.5 | 0.5 |
| Hampene ® 100 (EDTA) (40%) (1 g/L) (Hampshire Chemical Corp., Nashua, NH) | — | 0.1 | — | — | — | — |
| Hampol ® 120 (HEEDTA) (40%) (1 g/L) | — | — | 0.1 | — | — | — |
| Plexene ® D (DTPA) (40%) (1 g/L) (Sybron Chemicals Co., Milwaukee, WI) | | | | 0.1 | | |
| NTA-$Na_3$ crystals (40%) (0.43 g/L) (Hampshire Chemical Corp. Nashua, NH) | — | — | — | — | 0.043 | — |
| Neutralized DCTA (40%) (1 g/L): "(1 g/L)" (Aldrich Chemical Co., Milwaukee, WI) | — | — | — | — | — | 0.1 |

Observations of the resulting shades:

(A) Green (B) Olive (desired shade)

(C) Olive/slightly greener than (B)

(D) Olive/slightly greener than (B)

(E) Olive/noticeably greener than (B)

(F) Olive, equal to (B)

Conclusion:

All APCs tested show an improvement. EDTA was the optimum, even though all runs used equivalent amounts of the APCs.

The present invention may be embodied in other specific forms without departing from the spirit or essential attributes thereof and, accordingly, reference should be made to the appended claims, rather than to the foregoing specification as indicating the scope of the invention.

What is claimed is:

1. An aqueous dye bath, containing metal ion impurities, for dyeing a fabric, the dye bath comprising a reactive dye, a neutral salt present in an amount effective for salting out the dye on the fabric, and a phosphate-free and silicate-free alkali composition for promoting reaction of the dye on the fabric, the alkali composition consisting essentially of a water soluble base selected from the group consisting of alkali metal hydroxide, alkali metal carbonate and mixtures thereof, wherein the base is present in an amount sufficient to yield a dye bath pH of about 11 to about 12 at an alkali composition concentration of about 0.1 wt % to about 1 wt % in the dye bath, and an aminopolycarboxylate sequestrant in an amount sufficient to sequester the metal ion impurities and prevent destructive reactive dye hydrolysis in the dye bath.

2. The dye bath of claim 1, wherein the reactive dye is a metal-containing reactive dye sensitive to demetallization.

3. The dye bath of claim 2, wherein the metal-containing reactive dye is a metallized vinyl sulfone type of reactive dye.

4. The dye bath of claim 1, wherein the water soluble base is alkali metal hydroxide.

5. The dye bath of claim 1, wherein the alkali metal hydroxide is selected from the group consisting of potassium hydroxide and sodium hydroxide.

6. The dye bath of claim 1, wherein the alkali metal hydroxide is selected from the group consisting of potassium hydroxide and sodium hydroxide, and wherein the alkali metal carbonate is potassium carbonate.

7. The dye bath of claim 1, wherein the water soluble base is a mixture of potassium carbonate and alkali metal hydroxide selected from the group consisting of potassium hydroxide and sodium hydroxide.

8. The dye bath of claim 7, the alkali composition further consisting essentially of diethylenetriaminepenta (methylenephosphonic acid) in an amount sufficient to prevent destructive precipitation of the aminopolycarboxylate.

9. The dye bath of claim 1, the alkali composition further consisting essentially of diethylenetriaminepenta (methylenephosphonic acid) in an amount sufficient to prevent destructive precipitation of the aminopolycarboxylate.

10. The dye bath of claim 1, wherein the aminopolycarboxylate sequestrant has a structure of Formula (I):

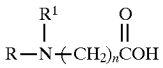

(I)

wherein n is 1 or 2 and

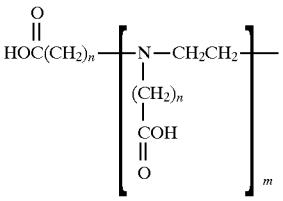

where m is 0–5; and

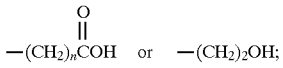

and any soluble salts thereof.

11. The dye bath of claim 1, wherein the aminopolycarboxylate is selected from the group consisting of nitrilotriacetic acid, N-hydroxyethyliminodiacetic acid, ethyienediaminetetraacetic acid, N-hydroxyethylethylenediaminetriacetic acid, diethylenetriaminepentaacetic acid, and diaminocyclohexanetetraacetic acid.

12. The dye bath of claim 1, wherein the aminopolycarboxylate is present in an amount of about 2 wt % to about 12 wt % based on the weight of the alkali composition, when the weight of the aminopolycarboxylate is calculated on a 100% basis of the free acid form of aminopolycarboxylate.

13. The dye bath of claim 1, wherein the alkali metal hydroxide is sodium hydroxide and is present in an amount of from about 3 wt % to about 40 wt % based on the weight of the alkali composition.

14. The dye bath of claim 1, wherein the alkali metal hydroxide is potassium hydroxide and is present in an amount of about 4 wt % to about 56 wt % based on the weight of the alkali composition.

15. The dye bath of claim 1, wherein the water soluble base comprises potassium carbonate present in the alkali composition in an amount of about 19 wt % to about 39 wt % based on the weight of the alkali composition.

16. The dye bath of claim 1, wherein the aminopolycarboxylate is present in an amount of about 3 wt % to about 8 wt % based on the weight of the alkali composition, when the weight of the aminopolycarboxylate is calculated on a 100% basis of the free acid form of aminopolycarboxylate.

17. The dye bath of claim 1 wherein the alkali metal hydroxide is sodium hydroxide and is present in an amount of from about 5 wt % to about 10 wt % based on the weight of the alkali composition.

18. The dye bath of claim 1 wherein the alkali metal hydroxide is potassium hydroxide and is present in an amount of about 7 wt % to about 14 wt % based on the weight of the alkali composition.

19. The dye bath of claim 31, wherein the water soluble base comprises potassium carbonate present in the alkali composition in an amount of about 24 wt % to about 34 wt % based on the weight of the alkali composition.

20. The dye bath of claim 1, wherein the aminopolycarboxylate is ethylenediaminetetraacetic acid present in an amount of about 4 wt % to about 7 wt % based on the weight of the alkali composition, when the weight of the ethylenediaminetetraacetic acid is calculated on a 100% basis of the free acid form of ethylenediaminetetraacetic acid.

21. The dye bath of claim 1, wherein the alkali metal hydroxide is sodium hydroxide present in an amount of about 6 wt % to about 8 wt % based on the weight of the alkali composition.

22. The dye bath of claim 1, wherein the alkali metal hydroxide is potassium hydroxide present in an amount of about 10 wt % to about 12 wt % based on the weight of the alkali composition.

23. The dye bath of claim 1, wherein the water soluble base comprises potassium carbonate present in the alkali composition in an amount of about 28 wt % to about 30 wt % based on the weight of the alkali composition.

24. The dye bath of claim 7, wherein the aminopolycarboxylate is present in an amount of about 3 wt % to about 8 wt % based on the weight of the alkali composition when the weight of the aminopolycarboxylate is calculated on a 100% basis of the free acid form of aminopolycarboxylate, the alkali hydroxide is sodium hydroxide present in an amount of about 5 wt % to about 10 wt % based on the weight of the alkali composition, and the potassium carbonate is present in an amount of about 24 wt % to about 34 wt % based on the weight of the alkali composition.

25. The dye bath of claim 24, wherein the aminopolycarboxylate is ethylenediaminetetraacetic acid present in an amount of about 4 wt % to about 7 wt %, the sodium hydroxide is present in an amount of about 6 wt % to about 8 wt %, and the potassium carbonate is present in an amount of about 28 wt % to about 30 wt %.

26. The dye bath of claim 7, wherein the aminopolycarboxylate is present in an amount of about 3 wt % to about 8 wt % based on the weight of the alkali composition, when the weight of the aminopolycarboxylate is calculated on a 100% basis of the free acid form of aminopolycarboxylate, the alkali hydroxide is potassium hydroxide present in an amount of about 7 wt % to about 14 wt % based on the weight of the alkali composition, and the potassium carbonate is present in an amount of about 24 wt % to about 34 wt % based on the weight of the alkali composition.

27. The dye bath of claim 26, wherein the aminopolycarboxylate is ethylenediaminetetraacetic acid present in an amount of about 4 wt % to about 7 wt %, the potassium hydroxide is present in an amount of about 10 wt % to about 12 wt %, and the potassium carbonate is present in an amount of about 28 wt % to about 30 wt %.

28. The dye bath of claim 8, wherein the aminopolycarboxylate is present in an amount of about 3 wt % to about 8 wt % based on the weight of the alkali composition when the weight of the aminopolycarboxylate is calculated on a 100% basis of the free acid form of aminopolycarboxylate, the alkali hydroxide is sodium hydroxide present in an amount of about 5 wt % to about 10 wt % based on the weight of the alkali composition, the potassium carbonate is present in an amount of about 24 wt % to about 34 wt %, and the diethylenetriaminepenta(methylenephosphonic acid) is present in an amount of about 0.12 wt % to about 0.5 wt % based on the weight of the alkali composition.

29. The dye bath of claim 28, wherein the aminopolycarboxylate is ethylenediaminetetraacetic acid present in an amount of about 4 wt % to about 7 wt %, the sodium hydroxide is present in an amount of about 6 wt % to about 8 wt %, and the potassium carbonate is present in an amount of about 28 wt % to about 30 wt %.

30. The dye bath of claim 8, wherein the aminopolycarboxylate is present in an amount of about 3 wt % to about 8 wt % based on the weight of the alkali composition, when the weight of the aminopolycarboxylate is calculated on a 100% basis of the free acid form of aminopolycarboxylate, the alkali hydroxide is potassium hydroxide present in an amount of about 7 wt % to about 14 wt % based on the weight of the alkali composition, the potassium carbonate is present in an amount of about 24 wt % to about 34 wt %, and the diethylenetriaminepenta(methylenephosphonic acid) is present in an amount of about 0.12 wt % to about 0.5 wt % based on the weight of the alkali composition.

31. The dye bath of claim 30, wherein the aminopolycarboxylate is ethylenediaminetetraacetic acid present in an amount of about 4 wt % to about 7 wt %, the potassium hydroxide is present in an amount of about 10 wt % to about 12 wt %, and the potassium carbonate is present in an amount of about 28 wt % to about 30 wt %.

32. The dye bath of claim 1, wherein the alkali composition is present in the dye bath in an amount of about 0.2 wt % to about 0.6 wt % based on the weight of the dye bath.

33. A method for dyeing a fabric capable of being dyed with a reactive dye to color the fabric, the method comprising the steps:

(a) providing an aqueous dye solution containing metal ion impurities and comprising the reactive dye, a neutral salt in an amount sufficient to cause enough of the dye to be absorbed by the fabric to color the fabric, and a phosphate-free, silicate-free aqueous alkali composition in an amount sufficient to promote reaction of the absorbed dye on the fabric, resulting in the absorbed dye being covalently bonded to the fabric and the fabric being colored, the aqueous alkali composition consisting essentially of a water soluble base selected from the group consisting of alkali metal hydroxide, alkali metal carbonate and mixtures thereof, wherein the base is present in the dye solution in an amount sufficient to yield a dye solution pH of about 11 to about 12 at an alkali composition concentration of about 0.1 wt % to about 1 wt % in the dye solution, and an aminopolycarboxylate sequestrant in an amount sufficient to sequester the metal ion impurities and prevent destructive reactive dye hydrolysis in the dye solution; and (b) contacting the fabric with the dye solution under conditions sufficient to dye the fabric.

34. The method of claim 33, wherein the reactive dye is a metal-containing reactive dye sensitive to demetallization.

35. The method of claim 34, wherein the metal-containing reactive dye is a metallized vinyl sulfone type of reactive dye.

36. The method of claim 33, wherein the reactive dye is a dye having a reactive function selected from the group consisting of dichlorotriazine, monoclorotriazine, vinyl sulfone, trichloro-pyrimidine, dichloro-quinoxaline, difluorochloro-pyrimidine, monofluorotriazine, fluorochloromethyl pyrimidine, and phosphonic acid.

37. The method of claim 33, wherein the water soluble base is alkali metal hydroxide.

38. The method of claim 37, wherein the alkali metal hydroxide is selected from the group consisting of potassium hydroxide and sodium hydroxide.

39. The method of claim 33, wherein the alkali metal hydroxide is selected from the group consisting of potassium hydroxide and sodium hydroxide, and wherein the alkali metal carbonate is potassium carbonate.

40. The method of claim 33, wherein the water soluble base is a mixture of potassium carbonate and alkali metal hydroxide selected from the group consisting of potassium hydroxide and sodium hydroxide.

41. The method of claim 40, the alkali composition further consisting essentially of diethylenetriaminepenta (methylenephosphonic acid) in an amount sufficient to prevent destructive precipitation of the aminopolycarboxylate.

42. The method of claim 33, the alkali composition further consisting essentially of diethylenetriaminepenta (methylenephosphonic acid) in an amount sufficient to prevent destructive precipitation of the aminopolycarboxylate.

43. The method of claim 33, wherein the aminopolycarboxylate sequestrant has a structure of Formula (I):

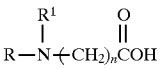

(I)

wherein n is 1 or 2 and

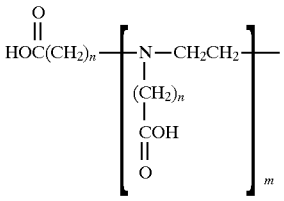

where m is 0–5; and

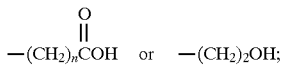

and any soluble salts thereof.

44. The method of claim 33, wherein the aminopolycarboxylate is selected from the group consisting of nitrilotriacetic acid, N-hydroxyethyliminodiacetic acid, ethylenediaminetetraacetic acid, N-hydroxyethylethylenediaminetriacetic acid, diethylenetriaminepentaacetic acid, and diaminocyclohexanetetraacetic acid.

45. The method of claim 33, wherein the aminopolycarboxylate is present in an amount of about 2 wt % to about 12 wt % based on the weight of the alkali composition, when the weight of the aminopolycarboxylate is calculated on a 100% basis of the free acid form of aminopolycarboxylate.

46. The method of claim 33, wherein the alkali metal hydroxide is sodium hydroxide and is present in an amount of from about 3 wt % to about 40 wt % based on the weight of the alkali composition.

47. The method of claim 33, wherein the alkali metal hydroxide is potassium hydroxide and is present in an amount of about 4 wt % to about 56 wt % based on the weight of the alkali composition.

48. The method of claim 33, wherein the water soluble base comprises potassium carbonate present in the alkali composition in an amount of about 19 wt % to about 39 wt % based on the weight of the alkali composition.

49. The method of claim 33, wherein the aminopolycarboxylate is present in an amount of about 3 wt % to about 8 wt % based on the weight of the alkali composition, when the weight of the aminopolycarboxylate is calculated on a 100% basis of the free acid form of aminopolycarboxylate.

50. The method of claim 33, wherein the alkali metal hydroxide is sodium hydroxide and is present in an amount of from about 5 wt % to about 10 wt % based on the weight of the alkali composition.

51. The method of claim 33, wherein the alkali metal hydroxide is potassium hydroxide and is present in an amount of about 7 wt % to about 14 wt % based on the weight of the alkali composition.

52. The method of claim 33, wherein the water soluble base comprises potassium carbonate present in the alkali composition in an amount of about 24 wt % to about 34 wt % based on the weight of the alkali composition.

53. The method of claim 33, wherein the aminopolycarboxylate is ethylenediaminetetraacetic acid present in an amount of about 4 wt % to about 7 wt % based on the weight of the alkali composition, when the weight of the aminopolycarboxylate is calculated on a 100% basis of the free acid form of ethylenediaminetetraacetic acid.

54. The method of claim 33, wherein the alkali metal hydroxide is sodium hydroxide present in an amount of about 6 wt % to about 8 wt % based on the weight of the alkali composition.

55. The method of claim 33, wherein the alkali metal hydroxide is potassium hydroxide present in an amount of about 10 wt % to about 12 wt % based on the weight of the alkali composition.

56. The method of claim 33, wherein the water soluble base comprises potassium carbonate present in the alkali composition in an amount of about 28 wt % to about 30 wt % based on the weight of the alkali composition.

57. The method of claim 40, wherein the aminopolycarboxylate is present in an amount of about 3 wt % to about 8 wt % based on the weight of the alkali composition when the weight of the aminopolycarboxylate is calculated on a 100% basis of the free acid form of aminopolycarboxylate, the alkali hydroxide is sodium hydroxide present in an amount of about 5 wt % to about 10 wt % based on the weight of the alkali composition, and the potassium carbonate is present in an amount of about 24 wt % to about 34 wt % based on the weight of the alkali composition.

58. The method of claim 37, wherein the aminopolycarboxylate is ethylenediaminetetraacetic acid present in an amount of about 4 wt % to about 7 wt %, the sodium hydroxide is present in an amount of about 6 wt % to about 8 wt %, and the potassium carbonate is present in an amount of about 28 wt % to about 30 wt %.

59. The method of claim 40, wherein the aminopolycarboxylate is present in an amount of about 3 wt % to about 8 wt % based on the weight of the alkali composition when the weight of the aminocarboxylate is calculated on a 100% basis of the free acid form of aminopolycarboxylate, the alkali hydroxide is potassium hydroxide present in an amount of about 7 wt % to about 14 wt % based on the weight of the alkali composition, and the potassium carbonate is present in an amount of about 24 wt % to about 34 wt % based on the weight of the alkali composition.

60. The method of claim 59, wherein the aminopolycarboxylate is ethylenediaminetetraacetic acid present in an amount of about 4 wt % to about 7 wt %, the potassium hydroxide is present in an amount of about 10 wt % to about 12 wt %, and the potassium carbonate is present in an amount of about 28 wt % to about 30 wt %.

61. The method of claim 41, wherein the aminopolycarboxylate is present in an amount of about 3 wt % to about 8 wt % based on the weight of the alkali composition when the weight of the aminopolycarboxylate is calculated on a 100% basis of the free acid form of aminopolycarboxylate, the alkali hydroxide is sodium hydroxide present in an amount of about 5 wt % to about 10 wt %, the potassium carbonate is present in an amount of about 24 wt % to about 34 wt % based on the weight of the alkali composition, and the diethylenetriaminepenta-(methylenephosphonic acid) is present in an amount of about 0.12 wt % to about 0.5 wt % based on the weight of the alkali composition.

62. The method of claim 61, wherein the aminopolycarboxylate is ethylenediaminetetraacetic acid present in an amount of about 4 wt % to about 7 wt %, the sodium hydroxide is present in an amount of about 6 wt % to about 8 wt %, and the potassium carbonate is present in an amount of about 28 wt % to about 30 wt %.

63. The method of claim 41, wherein the aminopolycarboxylate is present in an amount of about 3 wt % to about 8 wt % based on the weight of the alkali composition when the weight of the aminocarboxylate is calculated on a 100% basis of the free acid form of aminopolycarboxylate, the alkali hydroxide is potassium hydroxide present in an amount of about 7 wt % to about 14 wt % based on the weight of the alkali composition, the potassium carbonate is present in an amount of about 24 wt % to about 34 wt %, and the diethylene-triaminepenta(methylenephosphonic acid) is present in an amount of about 0.12 wt % to about 0.5 wt % based on the weight of the alkali composition.

64. The method of claim 63, wherein the aminopolycarboxylate is ethylenediaminetetraacetic acid present in an amount of about 4 wt % to about 7 wt %, the potassium hydroxide is present in an amount of about 10 wt % to about 12 wt %, and the potassium carbonate is present in an amount of about 28 wt % to about 30 wt %.

65. The method of claim 33, wherein the alkali composition is present in the dye solution in an amount of about 0.2 wt % to about 0.6 wt % based on the weight of the dye solution.

* * * * *

UNITED STATES PATENT AND TRADEMARK OFFICE

CERTIFICATE OF CORRECTION

PATENT NO : 5,840,084

DATED : November 24, 1998

INVENTOR(S) : Otto Bella *et al.*

It is certified that error appears in the above-identified patent and that said Letters Patent are hereby corrected as shown below:

Column 9, line 8: before "$HOC(CH_2)_n$ . . .", insert --R is--;

Column 9, line 18:before "--$(CH_2)_nCOH$. . .", insert --$R^1$ is--;

Column 21, line 38: before "$HOC(CH_2)_n$ . . .", insert --R is--;

Column 21, line 49, before "--$(CH_2)_nCOH$. . .", insert --$R^1$ is--;

Column 24, line 43, before "$HOC(CH_2)_n$ . . .", insert --R is--;

Column 24, line 53, before "--$(CH_2)_nCOH$. . .", insert --$R^1$ is--

Signed and Sealed this

Tenth Day of April, 2001

*Attest:*

Nicholas P. Godici

NICHOLAS P. GODICI

*Attesting Officer*

*Acting Director of the United States Patent and Trademark Office*